United States Patent [19]

Goodnough

[11] 4,392,516

[45] Jul. 12, 1983

[54] DRIVE FOR LOOM EASER BAR

[75] Inventor: Douglas D. Goodnough, Burlington, N.C.

[73] Assignee: Burlington Industries, Inc., Greensboro, N.C.

[21] Appl. No.: 270,552

[22] Filed: Jun. 4, 1981

[51] Int. Cl.[3] ..... D03D 49/00; D03C 7/00

[52] U.S. Cl. ..... 139/115; 139/50

[58] Field of Search ..... 139/115, 114, 101, 102, 139/103, 50, 51, 52

[56] References Cited

U.S. PATENT DOCUMENTS

| | | | |
|---|---|---|---|
| 1,031,733 | 7/1912 | Ricketson et al. | 139/50 |
| 2,103,836 | 12/1937 | Wakefield | 139/115 X |
| 2,704,557 | 3/1955 | Moberg | 139/50 |
| 3,072,153 | 1/1963 | Law | 139/115 X |

*Primary Examiner*—James Kee Chi

*Attorney, Agent, or Firm*—Cushman, Darby & Cushman

[57] ABSTRACT

An easer bar for controlling the tension of the warp threads in a loom controlled by a positive action dobby for weaving leno type fabrics is directly controlled by and connected to the dobby.

5 Claims, 1 Drawing Figure

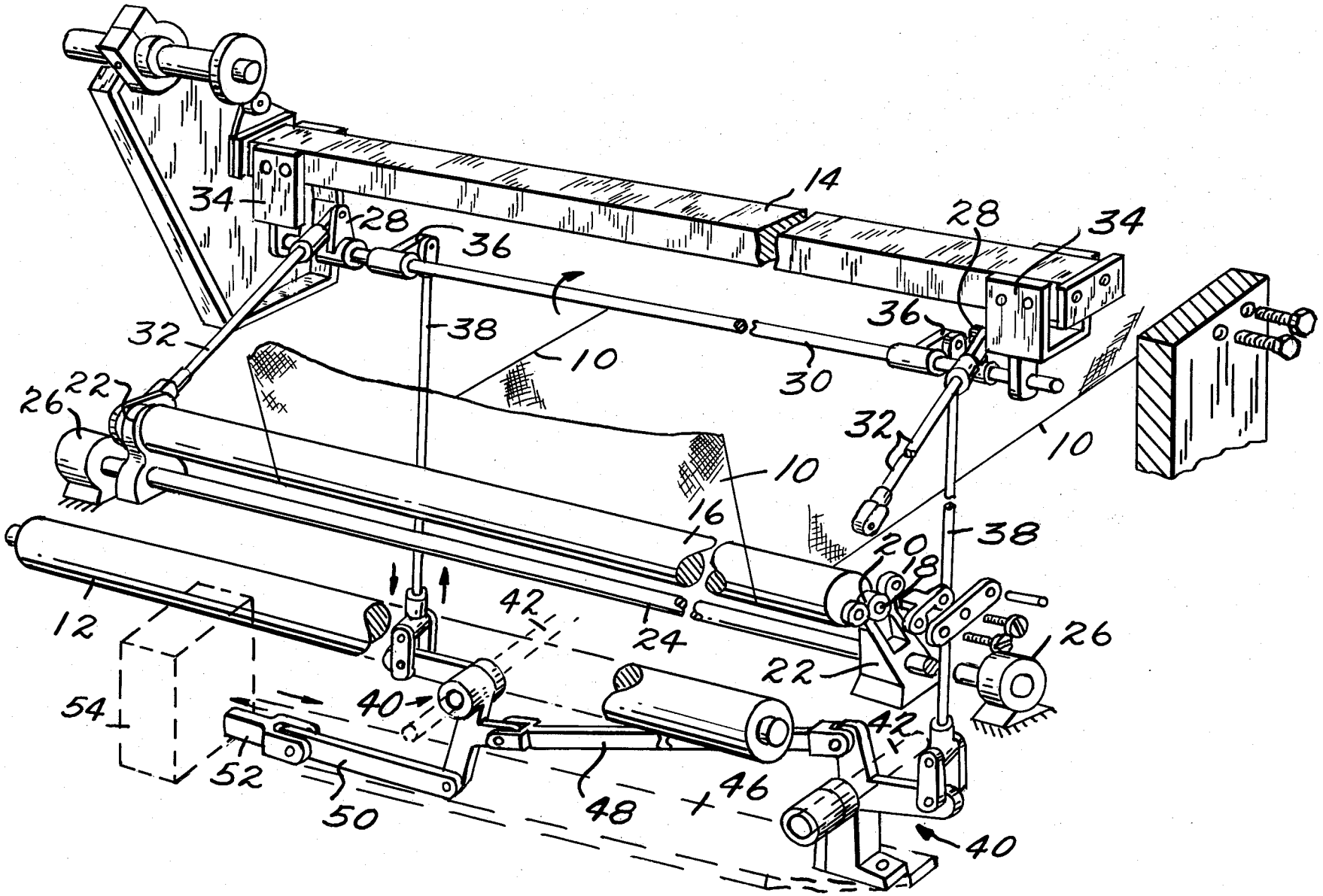
34
28
14
36
38
10
30
32
26
22
18
20
42
40
46
48
50
52
54
12
16
24

DRIVE FOR LOOM EASER BAR

FIELD OF THE INVENTION

This invention relates to looms or weaving machines and, more particularly, to improvements in varying warp tension for weaving stylized designs, such as leno patterns.

BACKGROUND OF THE INVENTION

The use of means for varying warp tension for fancy weaving of stylized designs, such as leno patterns, is not new. Among such means are easer-bar, slackener bars, jumper motions, etc. Those means have been operated, however, by negative type dobbies, i.e., they positively pulled the harness frames or heddles upward but the frames were pulled downward by springs. Similarly, the motion of the dobby-controlled easer-bar was negative, i.e., moved positively in one direction by the dobby, but moved in the opposite direction by springs.

Such known means for varying warp tension is satisfactory for old type fly-shuttle looms, but unsatisfactory for rapier type weaving machines which operate much faster. Full speed capabilities of rapier type looms cannot be obtained with negative motion easer-bars, even when such looms are equipped with positive motion dobbies which positively move the harness frames both upward and downward.

Moreover, some known types of easer-bars are in the form of three rollers, two fixed in spaced relation and the third movable between the two fixed rollers. This complicates the construction and renders it more expensive.

Examples of means for controlling warp tensions are disclosed in the following U.S. patents:

Bohan U.S. Pat. No. 2,246,658, June 14, 1941; willis et al. U.S. Pat. No. 2,551,920, May 8, 1951; Kulczycki et al. U.S. Pat. No. 2,589,498, Mar. 18, 1951; Pfarrwaller U.S. Pat. No. 3,125,128, Mar. 17, 1964.

Bohan is exemplary of a whip roll which is automatically raised and lowered to compensate for variations in warp tension, i.e., to maintain constant warp tension in a shedding cycle.

Willis discloses a whip roll which is moved, on movement of the shipper handle of the loom to "off" position, to relax the tension in the warp yarns to prevent "set marks".

Kulczycki et al discloses another type device for performing the same function as the movable whip roll of Bohan, i.e., maintaining constant warp tension during a shedding cycle.

Pfarrwaller discloses still another type of device for performing the same function as the devices disclosed in Willis and Kulczycki.

BRIEF SUMMARY OF THE INVENTION

Accordingly, it is an object of this invention to provide simple and inexpensive positive-motion easer-bar means controlled by a positive-motion dobby to control top beam warp tension in a high speed loom without limiting or restricting loom speed.

It is another object of this invention to provide such an easer-bar on a rapier type weaving machine which maintains positive control of the easer-bar motion and does not reduce or restrict machine speed.

These objects are accomplished by an easer-bar which overlies the top beam warp threads at the juncture of their vertical and their horizontal run and is mounted for rocking movement toward and away from the warp threads. Mechanical means positively connects the easer-bar to a positive-motion dobby to rock the easer-bar to decrease warp tension at predetermined intervals for weaving fancy leno type fabrics in accordance with the pattern of the dobby.

Other objects and advantages will become apparent from the following description and accompanying drawings, in which:

BRIEF DESCRIPTION OF THE DRAWING

The drawing is a schematic, partially exploded, perspective view of an easer-bar and driving means therefor embodying this invention.

DETAILED DESCRIPTION OF THE INVENTION

Referring now to the drawing, there is disclosed portions of a Dornier rapier type weaving machine having a frame and a top and a bottom warp beam (not shown) from which top beam warp threads 10 are drawn downwardly in a generally vertical and thence in a generally horizontal run under the arch member 14 of the frame through the usual shedding harnesses or heddles (not shown). Overlying, parallel to, and extending from side-to-side of the juncture of the vertical and horizontal run of the top beam warp threads 10 is an easer-bar in the form of a roller of light weight material, e.g., aluminum. Stub shafts 18 at each end of the roller 16 are rotatably mounted, by anti-friction bearings 20, to the ends of crank arms 22 fixedly attached to an oscillatory shaft 24 disposed parallel to the roller 16 beneath the horizontal run of the warp threads 10 and having its ends journalled in the side frame members 26 of the machine. It will be seen that the roller 16 can be rocked toward the whip roll 12 to increase the tension on warp threads 10 or rocked away from the whip roll to decrease or completely relieve the tension therein caused by engagement of the roller therewith.

Pivotally connected to each crank arm 22 and to a corresponding crank arm 28 attached to an oscillatory shaft 30 extending from side-to-side of the loom parallel to the shaft 24 beneath the arch member 14 of the frame is a connecting rod 32. The ends of the shaft 30 are journalled in brackets 34 fixed to and depending from the arch member 14. Attached to the shaft 30 adjacent the crank arms 28 are generally horizontal crank arms 36 each having a connecting rod 38 connected thereto for pivotal movement about an axis parallel to the shaft 30 and depending from such arm 36 below and at one side of the horizontal run of the warp threads 10. The lower end of each rod 38 is connected for pivotal movement about a horizontal axis to one generally horizontal arm of a corresponding double arm crank 40 mounted on a corresponding rod 42 for oscillation about a horizontal axis extending in a plane normal to the axis of the shaft 30. The crank mounting rods 42 are fastened by bracket structures 44 to side bed members 46 of the loom frame. The other arms of the double arm cranks 40 extend generally vartically, with one extending upwardly and the other downwardly. These arms of the cranks 40 are connected by a connecting rod 48 so that oscillation of one crank 40 causes the connecting rods 38 to move up or down in unison and thereby rock the easer-bar roller 16.

The generally vertical arm of one of the cranks 40 has a connecting rod 50 pivotally connected to the generally-horizontally positively-reciprocable member 52 of a dobby 54. Reciprocation of the member 52 is controlled by the predetermined pattern of the dobby 54 to rock the easer-bar roller 16 to decrease or relieve the tension in the warp threads 10 at predetermined intervals for weaving leno type stylized designs.

Although the preferred embodiment described hereinabove contemplates that the leno warp ends will be provided by a singular top beam, it is understood that the leno warp ends could be provided by a plurality of top beams or one or more bottom beams. Regardless of the location of the beam or beams providing the leno warp ends, leno warp ends will be contacted and tensioned by the easer bar of the present invention.

It thus will be seen that the objects and advantages of this invention have been fully and effectively achieved. It will be realized, however, that the foregoing specific embodiment has been disclosed only for the purpose of illustrating the principles of this invention and is susceptible of modification without departing from such principles. Accordingly, the invention includes all embodiments encompassed within the spirit and scope of the following claims.

I claim:

1. In a weaving machine having a frame, a top leno warp beam and a bottom ground warp beam, and a positive-motion dobby, the combination comprising:

easer-beam means overlying the top beam warp threads at the juncture of their vertical and their horizontal run;

crank arm means mounting said easer-bar means to the frame for rocking movement toward and away from the top beam warp threads to respectively increase and decrease the tension in the top beam warp threads; and mechanical means devoid of spring means mounted to the frame and connecting said easer-bar mounting means to the dobby for positively rocking said easer bar toward and away from the top beam warp threads in response to predetermined movements of the dobby.

2. The structure defined in claim 1 wherein the easer-bar means includes a roller which contacts the top beam warp threads.

3. The structure defined in claim 1 wherein the mechanical means includes:

an oscillatory shaft mounted to the frame above and parallel to the easer-bar means;

first rod and crank means connecting said shaft to the easer-bar mounting means for rocking said easer-bar on oscillation of said shaft;

oscillatory double arm crank means mounted to the frame below the horizontal run of the top beam warp threads;

second rod and crank means connecting said shaft to one arm of said double-arm crank means for oscillation of said shaft on oscillation of said double-arm crank means; and rod means connecting the other arm of said double-arm crank means to the dobby.

4. The structure defined in claim 3 wherein there are:

two crank arm means mounting the easer-bar means, one at each end thereof;

two first rod and crank means, one connected to each of said two crank arm means;

two double-arm crank means, one at each side of the machine, both mounted for oscillation about parallel axes located in planes normal to the shaft;

two second rod and crank means, each connecting said shaft to one arm of one of said double-arm crank means;

rod means connecting the other arms of said two double-arm crank means; and wherein the rod means recited in claim 3 connects the other arm of one of said double-arm crank means to the dobby.

5. In a weaving machine having a frame, leno and ground warp ends, and a positive-motion dobby, the combination comprising:

easer-bar means overlying the leno warp threads;

crank arm means mounting said easer-bar means to the frame for rocking movement toward and away from the leno warp threads to respectively increase and decrease the tension on the leno warp threads; and mechanical means mounted to the frame and connecting said easer-bar mounting means devoid of spring means to the dobby for positively rocking said easer bar toward and away from the leno warp threads in response to predetermined movements of the dobby.

* * * * *